United States Patent [19]

Harvey

[11] Patent Number: 4,510,417

[45] Date of Patent: Apr. 9, 1985

[54] SELF-SCAN GAS DISCHARGE DISPLAY PANEL

[75] Inventor: Edgar L. Harvey, Jamesburg, N.J.

[73] Assignee: Burroughs Corporation, Detroit, Mich.

[21] Appl. No.: 490,496

[22] Filed: May 2, 1983

[51] Int. Cl.[3] ..... H01J 17/49

[52] U.S. Cl. ..... 313/585

[58] Field of Search ..... 313/585, 584

[56] References Cited

U.S. PATENT DOCUMENTS

| | | | |
|---|---|---|---|
| 3,631,530 | 12/1971 | Ogle | 313/584 |
| 3,714,506 | 1/1973 | Kupsky | 313/585 X |
| 3,755,027 | 8/1973 | Gilsing | 313/584 X |
| 3,989,981 | 11/1976 | Ogle et al. | 313/584 X |
| 4,099,098 | 7/1978 | Cola | 313/585 X |

*Primary Examiner*—Palmer Demeo

*Attorney, Agent, or Firm*—Kevin R. Peterson; Edmund M. Chung; Robert A. Green

[57] ABSTRACT

A display panel comprising an array of scan cells formed by an array of row scan anodes and an array of column cathodes, the scan anodes operating with the lower surfaces of the cathodes to provide cathode glow. The panel also includes an array of display cells formed by an array of row display anodes and the same cathodes, the display anodes operating with restricted areas on the top surfaces of the cathodes to provide cathode glow. The rows of display cells are offset from the rows of scan cells so that the glow transfer path and display glow cells are disposed in an optimum location for panel operation and life.

2 Claims, 3 Drawing Figures

SELF-SCAN GAS DISCHARGE DISPLAY PANEL

BACKGROUND OF THE INVENTION

The present invention relates generally to SELF-SCAN gas discharge display panels of the type described and claimed in U.S. Pat. No. 3,989,981 of James A. Ogle and George E. Holz. The first form of panels of this type is described in this patent, and such panels have been made and sold for many years. Other forms of SELF-SCAN panels have been made through the years, and some of these are shown in U.S. Pat. No. 3,631,530 of James A. Ogle and in copending application Ser. No. 335,753, filed Dec. 30, 1981, by Edgar L. Harvey, now abandoned. The latter two panels have a construction which uses a different mode of transfer of glow from a scan cell to a display cell than is used in U.S. Pat. No. 3,989,981; however, completely satisfactory operation is not achieved. The present invention relates to a somewhat different SELF-SCAN panel which has improved operating characteristics and provides improved transfer of glow from scan cells to display cells.

DESCRIPTION OF THE INVENTION

Figure 1:
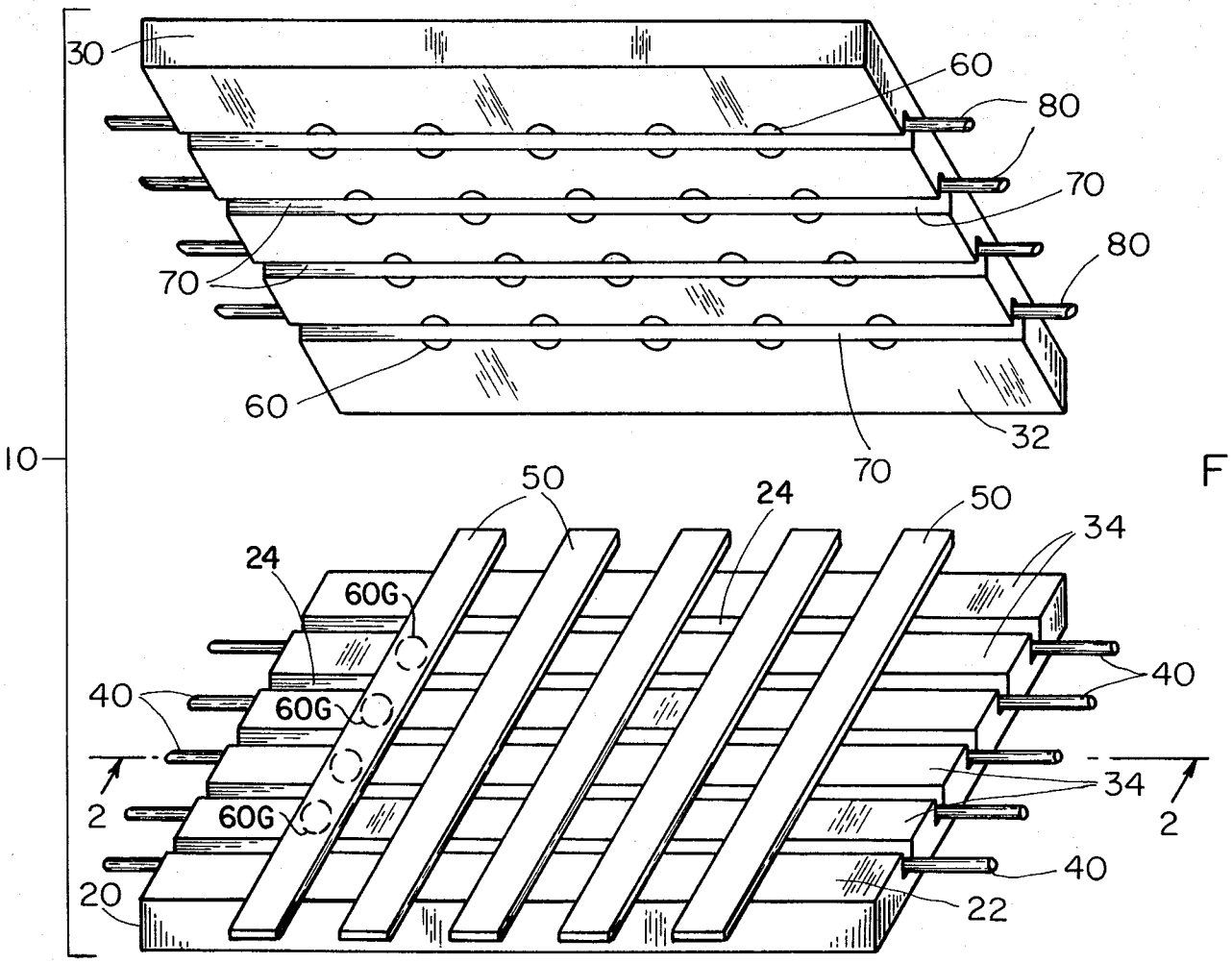
FIG. 1 is a perspective, exploded view of a display panel embodying the invention.

A display panel 10 embodying the invention includes an insulating base plate 20 and a glass face plate 30 which are hermetically sealed together to form an enclosure which is filled with a suitable ionizable gas, as is well known in the art. The insulating base plate 20 has a top surface 22 which is provided with a plurality of parallel, horizontal slots 24 in which scan anode electrodes 40 are secured. A plurality of parallel cathode electrodes 50, in the form of strips, are seated on the top surface of the base plate but oriented at an angle, usually 90°, to the anodes 40. Each crossing of the anodes 40 by a cathode 50 defines a column of gas-filled scan cells formed between each anode and the lower surface of each cathode, and, along each anode, the cathodes define a row of gas-filled scan cells. Thus, the assembly of base plate and anodes and cathodes defines an array of rows and columns of gas-filled scan cells.

The face plate 30 is seated on the base plate 20 and on the cathodes 50, and the lower surface 32 of the face plate is provided with an array of depressions 60 arrayed in rows and columns, with one depression being provided for and in operative relation with each scan cell in the base plate assembly. A plurality of parallel display slots 70 are also provided in the lower surface of the face plate, these slots extending in the same direction as slots 24 in the base plate 20. A display anode 80 is secured in each of the display slots 70. The display slots and display anodes lie along and within the rows of depressions. The depressions may be circular or have any other shape suitable for operating as described below.

The display anodes cross each cathode, and each such crossing defines a display cell between the anode and the top surface of the cathode. Thus, there are rows and columns of display cells as there are rows and columns of scan cells.

The display slots 70 and display anodes 80 are related to the scan anodes 40 and cathodes 50 in such a way that the display slots and display anodes overlie and extend along the lands 34 of the base plate between scan slots 24, and the depressions 60 are each disposed directly above a cathode. The depressions are smaller in diameter than the width of a cathode, as illustrated by the dash lines in FIG. 1 representing the projection of the display slots and depressions onto the surface of the base plate.

The panel 10 is operated in the same way as other SELF-SCAN panels in that the scan cells are energized and turned on column-by-column, and then, as the columns of scan cells are scanned, data signals are applied to selected display anodes to cause glow to transfer from a scan cell to the selected display cell, and all of the display cells which are turned on present a changeable but apparently stationary message.

In the panel 10, as the scan cells are energized and turned on column-by-column, cathode glow is produced between all of the scan anodes and the lower surface of the cathodes positioned above them. When data signals are applied to selected display anodes or all of the display anodes, glow transfers from a scan cell to the selected display cell adjacent to it. Display glow is now present between one or more display anodes and the top surface of the associated cathode and in the associated depressions 60.

Figure 2:
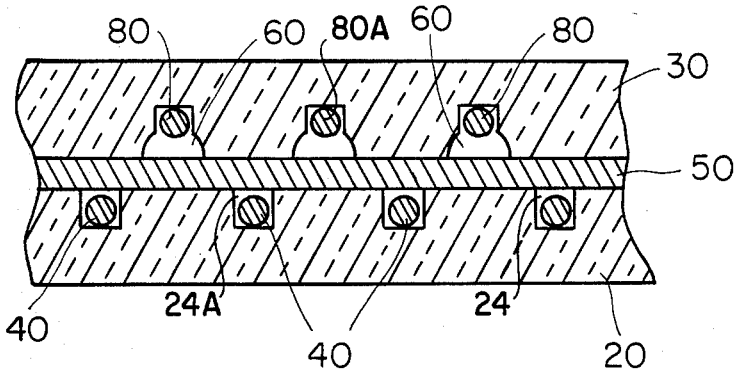
FIG. 2 is a sectional view along the lines 2—2 in FIG. 1 of a portion of the panel of FIG. 1 shown assembled.
Figure 3:
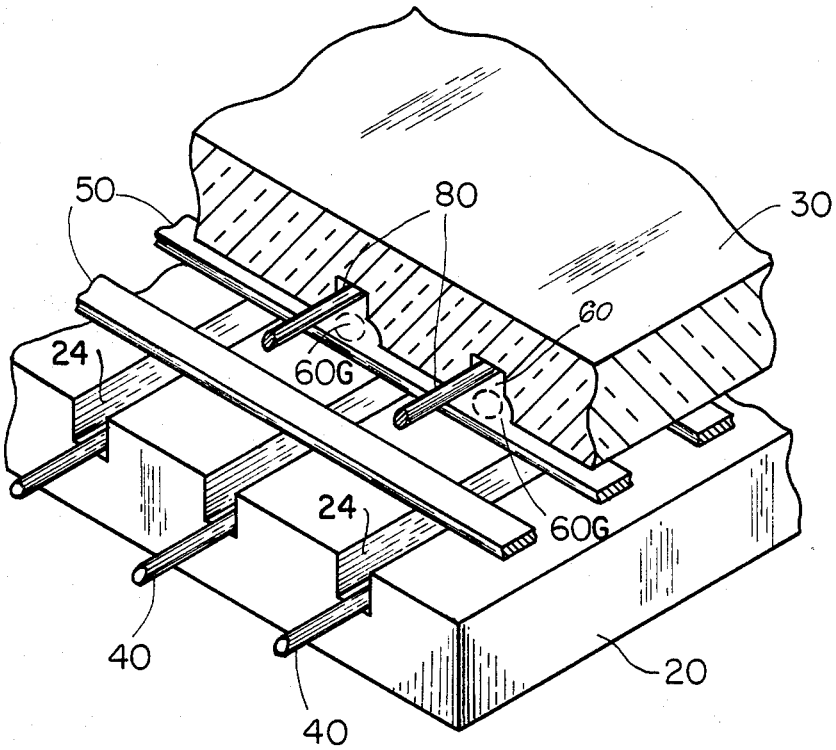
FIG. 3 is a perspective view of a portion of the invention.

Referring to FIG. 2, to illustrate the transfer of glow, if a column of scan cells defined by cathode 50 are on and glowing at the lower surface of the cathode and a data signal is applied to display anode 80A, glow will flow from slot 24A along the edge 52 of the cathode to about the location of the display anode 80A above it, and it will move onto the top surface of the cathode beneath the display anode 80A where the glow will be sustained by the potential between the display anode 80A and the cathode. The glow will actually lodge in the depression 60 associated with the data-driven display anode. This occurs with all glow transfer to provide the visible message. Areas of display glow are represented by the dash line circles 60G on the leftmost cathode 50 in FIG. 1 and on the second cathode 50 in FIG. 3.

One of the important advantages of the display panel construction described above is that display glow does not appear at an edge of a cathode, but is limited to an area on the surface of a cathode. Thus, differential aging or sputtering of the edge of a cathode cannot affect display glow.

What is claimed is:

1. A display panel comprising a gas-filled envelope made up of a base plate and a face plate sealed together hermetically, a plurality of parallel, longitudinal scan slots formed in the top surface of said base plate, there being a land between adjacent slots, a scan anode secured in each of said scan slots, a plurality of cathodes in the form of strips, each having a top surface and a bottom surface, seated parallel to each other adjacent to the top surface of said base plate and oriented transverse to said scan anodes so that each crossing of a cathode with the scan anodes forms a scan cell made up of the scan anode and the lower surface of the cathode above it, an array of depressions formed in the lower surface of said base plate inside said envelope, there being one depression for each scan cell, the depressions being arrayed in rows and columns, a plurality of parallel, longitudinal display slots in the lower surface of said face plate, said display slots being parallel to said scan slots and extending along and through the rows of depressions, and a display anode secured in each display slot and oriented parallel to the scan anodes and transverse to said cathodes so that each crossing of said display anodes by a cathode forms a display cell made up of the display anode and the portion of the top surface of the cathode beneath it, said display slots and said depressions being oriented along and overlying the lands between the scan slots, and said depressions overlying cathode electrodes, said depressions being smaller in diameter than the cathodes are wide, said panel being operated by turning on said scan cells column-by-column and generating cathode glow between the scan cathodes and the lower surface of each cathode and simuntaneously energizing selected display anodes to cause glow to transfer from a scan cell along the edge of a cathode and onto the top surface of the cathode beneath a selected display anode where the glow remains.

2. The panel defined in claim 1 wherein said depressions are generally circular in cross-section.

* * * * *